US007417609B2

(12) United States Patent
Richards

(10) Patent No.: US 7,417,609 B2
(45) Date of Patent: Aug. 26, 2008

(54) PREVENTION OF CHARGE ACCUMULATION IN MICROMIRROR DEVICES THROUGH BIAS INVERSION

(75) Inventor: Peter R. Richards, San Francisco, CA (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 11/860,835

(22) Filed: Sep. 25, 2007

(65) Prior Publication Data

US 2008/0013146 A1 Jan. 17, 2008

Related U.S. Application Data

(62) Division of application No. 10/607,687, filed on Jun. 27, 2003, now Pat. No. 7,274,347.

(51) Int. Cl.
*G09G 3/34* (2006.01)

(52) U.S. Cl. ..... 345/84; 345/108; 345/204; 345/205

(58) Field of Classification Search ..... 345/84, 345/108, 204–205
See application file for complete search history.

(56) References Cited

U.S. PATENT DOCUMENTS

| | | | | |
|---|---|---|---|---|
| 4,441,791 | A | 4/1984 | Hornbeck | |
| 6,046,840 | A * | 4/2000 | Huibers | 359/291 |
| 6,724,379 | B2 * | 4/2004 | Markis | 345/209 |
| 2004/0190716 | A1 | 9/2004 | Nelson | |

* cited by examiner

*Primary Examiner*—Richard Hjerpe
*Assistant Examiner*—Leonid Shapiro
(74) *Attorney, Agent, or Firm*—Wade James Brady, III; Frederick J. Telecky, Jr.

(57) ABSTRACT

Methods and apparatus are provided for preventing charge accumulation in microelectromechanical systems, especially in micromirror array devices having a plurality of micromirrors. Voltages are applied to the micromirrors for actuating the micromirrors. Polarities of the voltage differences between mirror plates and electrodes are inverted so as to prevent charge accumulation.

63 Claims, 6 Drawing Sheets

PREVENTION OF CHARGE ACCUMULATION IN MICROMIRROR DEVICES THROUGH BIAS INVERSION

This application is a divisional of application Ser. No. 10/607,687, filed Jun. 27, 2003 now U.S. Pat. No. 7,274,347.

TECHNICAL FIELD OF THE INVENTION

The present invention is related generally to the art of microelectromechanical systems, and, more particularly, to methods and apparatus for preventing charge accumulation in micromirror devices.

BACKGROUND OF THE INVENTION

As the market demands continuously increase for display systems with higher resolution, greater brightness, lower power, lighter weight and more compact size, spatial light modulators having micromirrors and micromirror arrays have blossomed in display applications. FIG. 1 presents a simplified exemplary display system employing a spatial light modulator. In its very basic configuration, the display system comprises light source 102, optical devices (e.g. light pipe 106, condensing lens 108 and projection lens 116), display target 118 and spatial light modulator 114 that further comprises a plurality of micromirror devices (e.g. an array of micromirror devices). Light source 102 (e.g. an arc lamp) emits light through the light integrator/pipe 106 and condensing lens 108 and onto spatial light modulator 114. Each micromirror device (e.g. micromirror device 110 or 112) of spatial light modulator 114 is associated with a pixel of an image or a video frame and is selectively actuated by a controller (e.g. as disclosed in U.S. Pat. No. 6,388,661 issued May 14, 2002 incorporated herein by reference) so as to reflect light from the light source either into (the micromirror at the ON state) or away from (the micromirror at the OFF state) projection optics 116, resulting in an image or a video frame on display target 118 (screen, a viewer's eyes, a photosensitive material, etc.).

It is generally advantageous to drive the micromirrors of a spatial light modulator with as large a voltage as possible. For example, in a spatial light modulator having an array of micromirrors, a large actuation voltage increases the available electrostatic force available to move the micromirrors associated with pixel elements. Greater electrostatic forces provide more operating margin for the micromirrors—increasing yield. Moreover, the electrostatic forces actuate the micromirrors more reliably and robustly over variations in processing and environment. Greater electrostatic forces also allow the hinges of the micromirrors to be made correspondingly stiffer; stiffer hinges may be advantageous since the material films used to fabricate them may be made thicker and therefore less sensitive to process variability, improving yield. Stiffer hinges may also have larger restoration forces to overcome stiction. The pixel switching speed may also be improved by raising the drive voltage to the pixel, allowing higher frame rates, or greater color bit depth to be achieved.

The application of a high-voltage, however, has disadvantages, one of which is charge accumulation in micromirror devices. Referring to FIG. 2, a cross-sectional view of a micromirror device used in the spatial light modulator in FIG. 1 is illustrated therein. The micromirror device comprises mirror plate 134. The mirror plate rotates relative to glass substrate 130 and reflects light traveling through the glass substrate into different directions. The rotation is achieved by establishing an electrostatic field between the mirror plate and electrode 140, which is formed on substrate 132. In most cases, a dielectric layer, such as dielectric layer 138 (e.g. a $SiO_2$ layer and/or a $SiN_x$ layer), is deposited around the edges of the electrode for passivation of the electrode. In operation, the mirror plate and the electrode are connected to a voltage source so as to establish a voltage difference between the mirror plate and the electrode. The voltage difference results in an electrostatic force exerted on the mirror plate for driving the mirror plate to rotate. The voltages applied to the mirror plate and the electrode; however, induce charge to accumulate on the surface of the dielectric layers as shown. These charges accumulate during the operation of the micromirror device, and establish an additional electric field between the mirror plate and the electrode. This additional electric field in turn reduces the electric field created by voltage source 142. Consequently, the electrostatic force exerted to the mirror plate is reduced. That is, the voltage difference necessary to rotate the mirror plate to the desired angle is shifted towards higher voltage. In this situation, operation of the micromirrors of the spatial light modulator becomes unreliable.

Therefore, what is needed is a method and apparatus for providing a high voltage between a micromirror plate and the associated electrode while preventing charge accumulation.

SUMMARY OF THE INVENTION

In an embodiment of the invention, a method of operating a micromirror device that comprises a movable mirror plate and an electrode formed on a substrate for driving the mirror plate is disclosed. The method comprises: applying a first voltage to the mirror plate and a second voltage to the electrode such that a voltage difference between the mirror plate and the electrode drives the mirror plate to rotate relative to the substrate; and applying a third voltage to the mirror plate, and a fourth voltage to the electrode such that the voltage difference between the mirror plate and the electrode drives the mirror plate to rotate relative to the substrate, wherein difference between the third voltage and the fourth voltage has an opposite polarity to that between the first voltage and the second voltage.

In another embodiment of the invention, a method of operating a display system that comprises an array of micromirrors, each micromirror comprising a mirror plate and an electrode for rotating the mirror plate, is disclosed. The method comprises: directing a light beam onto the micromirror array; and selectively reflecting the light beam into an optical element for producing an image or a video frame on a display target, which further comprises: selecting one or more micromirrors from the micromirror array according to a gray scale of the image or the video frame; applying a first voltage to the mirror plate and a second voltage to the electrode of the selected micromirror such that voltage difference between the mirror plate and the electrode drives the mirror plate to rotate to one of the ON state and OFF state of the micromirror relative to the substrate at one time; and applying a third voltage to the mirror plate, and a fourth voltage to the electrode of the selected micromirror such that the voltage difference between the mirror plate and the electrode drives the mirror plate to rotate relative to the substrate, wherein difference between the third voltage and the fourth voltage has an opposite polarity to that between the first voltage and the second voltage at another time.

In yet another embodiment of the invention, a display system is disclosed. The display systems comprises: a light source; an array of micromirrors, each micromirror comprises a mirror plate and an electrode associated with the mirror plate for driving the mirror plate to rotate; a voltage controller that: a) sets the mirror plate to a first voltage and the electrode to a second voltage such that the difference between the first voltage and the second voltage drives the mirror plate to rotate; b) sets the mirror plate to a third voltage and the electrode to a fourth voltage such that the difference between the third voltage and the fourth voltage drives the mirror plate to rotate; and c) wherein the difference between the first voltage and second voltage has an opposite polarity than that between the third voltage and the forth voltage; and a plurality of optical elements for directing light from the light source onto the array of micromirrors and directing the reflected light from the micromirrors onto a display target for producing an image or an video frame.

In yet another embodiment of the invention, a display system is disclosed. The display system comprises: a light source; an array of micromirrors, each micromirror comprises a mirror plate and an electrode associated with the mirror plate for driving the mirror plate to rotate; a voltage controller that further comprise: a means for setting the mirror plate to a first voltage and the electrode to a second voltage such that the difference between the first voltage and the second voltage drives the mirror plate to rotate; a means for setting the mirror plate to a third voltage and the electrode to a fourth voltage such that the difference between the third voltage and the fourth voltage drives the mirror plate to rotate; and wherein the difference between the first voltage and second voltage has an opposite polarity than that between the third voltage and the fourth voltage; and a plurality of optical elements for directing light from the light source onto the array of micromirrors and directing the reflected light from the micromirrors onto a display target for producing an image or an video frame.

In yet another embodiment of the invention, a computer-readable medium is disclosed. The computer-readable medium has computer-executable instructions for performing steps of controlling spatial light modulations of an array of micromirrors used in a display system, wherein each micromirror of the array comprises a movable mirror plate and an electrode driving the mirror plate to rotate, the steps comprising: selecting one or more micromirrors from the micromirror array according to a gray scale of an image or a video frame; applying a first voltage to the mirror plate and a second voltage to the electrode of the selected micromirror such that voltage difference between the mirror plate and the electrode drives the mirror plate to rotate to one of the ON state and OFF state of the micromirror relative to the substrate at one time; and applying a third voltage to the mirror plate, and a fourth voltage to the electrode of the selected micromirror such that the voltage difference between the mirror plate and the electrode drives the mirror plate to rotate to an ON state to an OFF state relative to the substrate, wherein difference between the third voltage and the fourth voltage has an opposite polarity to that between the first voltage and the second voltage.

In yet another embodiment of the invention, a projector is disclosed. The projector comprises: a light source; a spatial light modulator that selectively reflecting light from the light source modulator that comprises an array of micromirrors, each micromirror having a movable mirror plate and an electrode driving the mirror plate to rotate; a controller having computer-executable instructions for performing steps of controlling the selective reflection of the spatial light modulator, the steps comprising: selecting one or more micromirrors from the micromirror array according to a gray scale of an image or a video frame; applying a first voltage to the mirror plate and a second voltage to the electrode of the selected micromirror such that voltage difference between the mirror plate and the electrode drives the mirror plate to rotate to one of the ON state and OFF state of the micromirror relative to the substrate at one time; and applying a third voltage to the mirror plate, and a fourth voltage to the electrode of the selected micromirror such that the voltage difference between the mirror plate and the electrode drives the mirror plate to rotate to the ON or OFF state relative to the substrate, wherein the difference between the third voltage and the fourth voltage has an opposite polarity to that between the first voltage and the second voltage; and a plurality of optical elements for directing light from the light source onto the spatial light modulator and projecting the reflected light from the spatial light modulator onto a display target of the projector.

BRIEF DESCRIPTION OF DRAWINGS

While the appended claims set forth the features of the present invention with particularity, the invention, together with its objects and advantages, may be best understood from the following detailed description taken in conjunction with the accompanying drawings of which:

DETAILED DESCRIPTION OF THE EMBODIMENTS

The present invention provides a method and an apparatus for preventing charge accumulation in micromirror devices by inverting the polarity of the voltage difference across the mirror plate and the electrode of the micromirror device. Specifically, a first voltage difference is established between the mirror plate and the electrode for rotating the mirror plate at one time. At another time, a second voltage difference having an opposite polarity to the first voltage difference is established between the mirror plate and the electrode for rotating the mirror plate.

Figure 2:
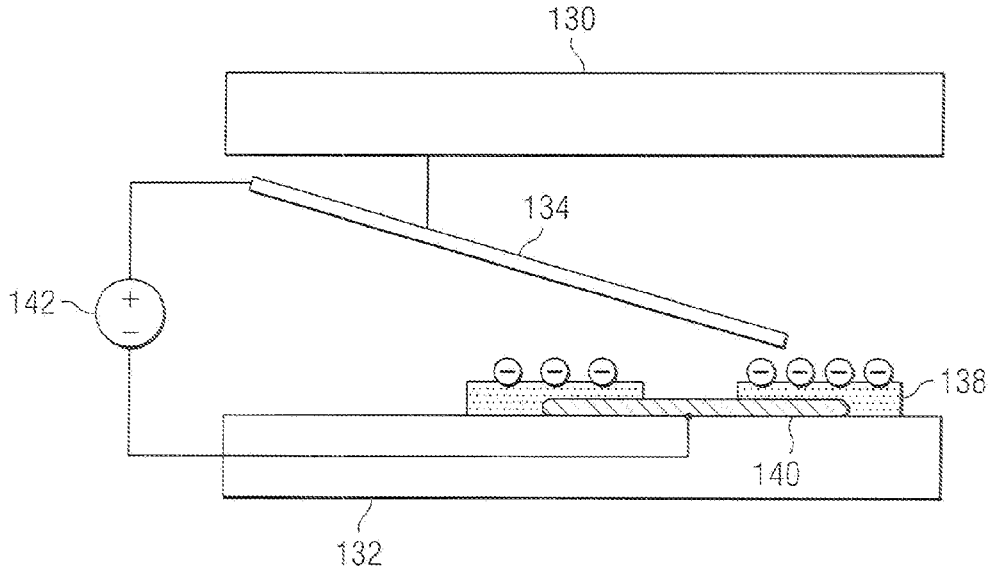
FIG. 2 illustrates is a cross-sectional view of a simplified micromirror device of FIG. 1, the device having charges accumulated on the dielectric materials of the micromirror device.
Figure 3:
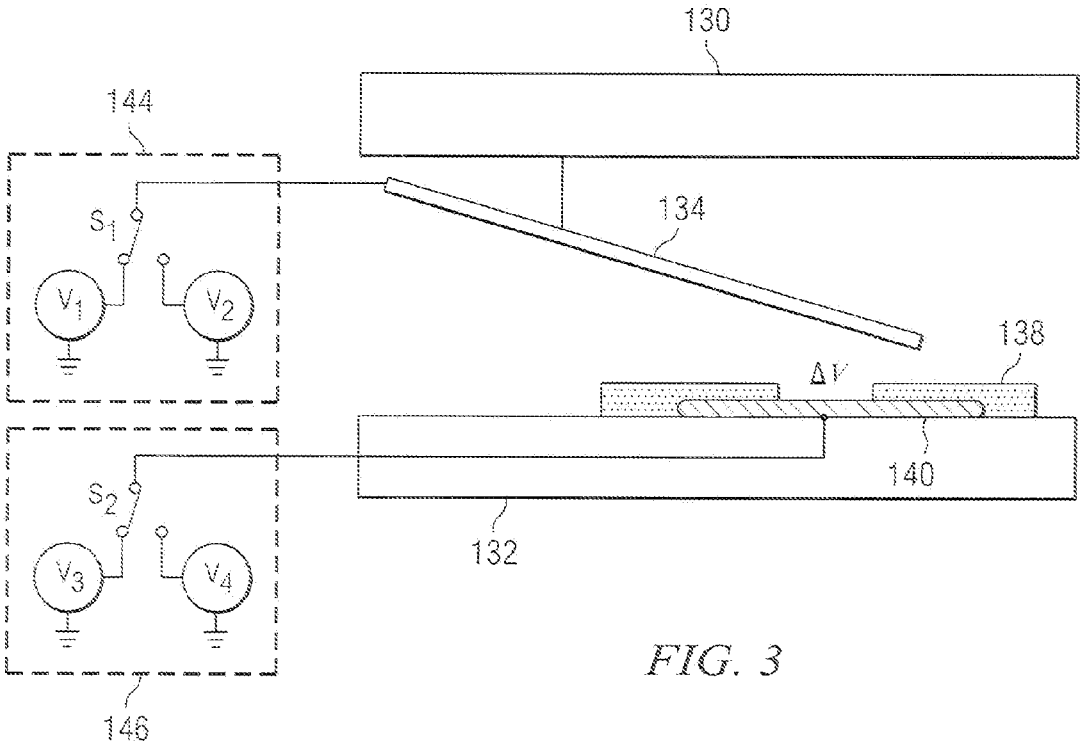
FIG. 3 illustrates an apparatus and functions of the apparatus for removing and preventing the accumulated charges in FIG. 2 according to an embodiment of the invention.

The voltage differences with different polarities can be achieved in a variety of ways, one of which is illustrated in FIG. 3. Referring to FIG. 3, the mirror plate is connected to voltage source 144 and the electrode is connected to voltage source 146. Voltage source 144 comprises two voltage states, $V_1$ and $V_2$. By switching the switch $S_1$ between the two voltage states, different voltages can be applied to the mirror plate. Voltage source 146 comprises two voltage states $V_3$ and $V_4$. Switch $S_2$ switches between the two voltage states and enables the two voltages to be applied to the electrode. According to the invention, the voltages applied to the mirror plate and the electrode should be those such that the voltage difference between the mirror plate and the electrode is able to drive the mirror plate to rotate to either the ON state or the OFF state. Specifically, the differences between voltages $V_1$ and $V_3$, and $V_2$ and $V_4$, each can drive the mirror plate to rotate relative to substrate 130 to the ON state as shown in FIG. 3, or the OFF state (not shown). Of course, if the OFF state is a non-deflection state (e.g. a state where the mirror plate is parallel to substrate 130 in FIG. 2), voltages may be applied only for the ON state. The polarity of the difference between $V_1$ and $V_3$ is opposite to that between $V_2$ and $V_4$, which can be expressed as sign $(V_1-V_3)=-$sign $(V_2-V_4)$. According to the invention, the voltages $V_1$, $V_2$, $V_3$ and $V_4$, each can be a voltage preferably from −100 volts to −100 volts, preferably from −30 volts to +30 volts, and more preferably around +30 volts or −20 volts. Regardless of the voltages selected for the mirror plate and the electrode, the voltage difference between the mirror plate and the electrode preferably has an absolute value from 15 volts to 80 volts, preferably from 25 volts to 50 volts, and more preferably around 30 volts or 20 volts.

As a way of example, assuming $V_1$, $V_2$, $V_3$ and $V_4$ are +30 volts, −20 volts, +10 volts and 0 volt, respectively, wherein at least +30 volts (or −30 volts) is required to rotate the mirror plate to the ON state angle (e.g. 16° degrees relative to the substrate) regardless of the polarity, table 1 lists the different voltage differences and corresponding states of the micromirror device. In this particular example, +30 volts and −30 volts correspond to the ON state of the micromirror device, because both +30 volts and −30 volts can rotate the mirror plate to the ON state angle regardless of their polarity. +20 volts and −20 volts are associated with the OFF state of the micromirror device.

TABLE 1

| $S_1$ and $S_2$ | $V_{plate}$ | $V_{electrode}$ | $\Delta V$ | Device state |
|---|---|---|---|---|
| $S_1=V_1$ $S_2=V_4$ | +30 V | 0 V | +30 V | ON |
| $S_1=V_2$ $S_2=V_3$ | −20 V | +10 V | −30 V | ON |
| $S_1=V_1$ $S_2=V_3$ | +30 V | +10 V | +20 V | OFF |
| $S_1=V_2$ $S_2=V_4$ | −20 V | 0 V | −20 V | OFF |

+20 volts and −20 volts are associated with the OFF state of the micromirror device. Alternative to non-zero voltage differences for the OFF state, a zero voltage difference can be selected for the OFF state. Specifically, the same voltage (e.g. non-zero or zero or ground voltage) including the polarity can be applied to both the mirror plate and the electrode.

In addition to voltage sources 144 and 146, other voltage sources may also be provided, especially for the OFF state of the micromirror. For an example, a second electrode (not shown) separate from electrode 140 can be provided for driving the mirror plate to the OFF state, as set forth in U.S. patent application "Micromirrors with OFF-angle electrodes and stops" filed May 23, 2003 to Huibers, the subject matter being incorporated herein by reference. For an example, the second electrode is an electrode film deposited on the lower surface (the surface facing the mirror plate) of substrate 130, in which case, the electrode film is transparent to visible light. In operation, different voltages are applied to the electrode film so as to build up electrical fields between the mirror plate and the electrode film for rotating the mirror plate to the OFF state. The voltage difference between the electrode film and the mirror plate varies coordinately with the voltage difference between the mirror plate and the first electrode (e.g. electrode 140). In the above example, assuming that a voltage having an absolute value of at least 20 volts is required to rotate mirror plate 134 from the ON state to the OFF state, for example, from the ON state angle (an angle from +14° to 18° degrees) to the OFF state angle (an angle from −2° to −6° degrees) or the non-deflection state, voltages of +10 volts and 0 volt are applied to the electrode film during operation. Specifically, +10 volts is applied to the electrode film when the mirror plate is at +30 volts, and 0 volt is applied to the electrode film when the mirror plate is at −20 volts. Applications of +10 volts and 0 volt to the electrode film and switches between these voltages are coordinated with the voltage applications to the mirror plate. Rather than providing the second electrode for the OFF state as an electrode film, the second electrode can also be an electrode frame or strips on the lower surface of substrate 130. Alternatively, the second electrode can be disposed at the same substrate (e.g. substrate 132) as the first electrode.

According to the invention, voltage source 146 is a memory cell circuitry preferably having a high voltage state and a low voltage state. Examples of such memory cell are standard DRAM, SRAM and SRAM having five transistors. Of course, other types of memory cells, such as a memory cell having one voltage state or a memory cell having more than two voltage states, may also be employed. It is generally advantageous to drive the micromirror device with as large a voltage as possible. A large actuation voltage increases the available electric force available to move the mirror plate. Greater electric forces provide more operating margin for the micromirror devices—increasing yield—and actuate them more reliably and robustly over variations in processing and environment. Greater electric forces also allow the hinges of the mirror plates to be made correspondingly stiffer; stiffer hinges may be advantageous since the material films used to fabricate them may be made thicker and therefore less sensitive to process variability, improving yield. The mirror plate switching speed (between the ON and OFF states) may also be improved by raising the drive voltage to the pixel, allowing higher frame rates, or greater color bit depth to be achieved. In view of these and other advantages of high voltages, voltage source 146 is preferably a "charge pump pixel cell", as set forth in U.S. patent application Ser. No. 10/340,162 filed Jan. 10, 2003 to Richards, the subject matter being incorporated herein by reference, though other designs for achieving voltages higher than 5 volts could be used. As disclosed in the patent application, a typical charge pump pixel cell comprises a transistor and a storage capacitor, wherein the transistor further comprises a source, a gate and a drain, and the storage capacitor has a first plate and a second plate. The source of the transistor is connected to a bitline, the gate of the transistor is connected to a wordline and the drain is connected to the first plate of the capacitor forming a storage node, and the second plate is connected to a pump signal.

When pluralities of such micromirror devices are arranged into a micromirror array device, the mirror plates are electrically connected together, forming a continuous mirror plate array with the same voltage at all time. Therefore, voltage source 144 is preferably provided as a common voltage source for all the mirror plates of the micromirror array. Of course, other voltage sources other than voltage source 144 may also be provided for the mirror plate array if necessary. Alternatively, voltage sources may be provided for different subsets of micromirrors of the micromirror array. Specifically, the micromirror array can be divided into a plurality of subsets of micromirrors, and each subset has one or more micromirrors. For example, a micromirror subset can be the micromirrors of a row or a column of the micromirror array. For another example, a micromirror subset can be a group of micromirrors selected from different rows and/or columns of the micromirror array as desired. Each micromirror subset is provided with one or more voltage sources. The voltage sources for separate micromirror subsets may provide different voltages to the mirror plates and the electrodes of the micromirrors and independently generate different voltage differences between mirror plates and electrodes of micromirrors of different subsets.

In the micromirror array, each electrode is provided with a separate voltage source, such as voltage source 146 preferably in a form of charge pump pixel cell or a memory cell having a plurality of voltage states. These voltage sources can be controlled individually. Specifically, each voltage source can be addressed and the voltage state of the addressed voltage source can be switched independently. Examples of such voltage source array are charge pump pixel array as set forth in U.S. patent application Ser. No. 10/340,162 filed Jan. 10, 2003 to Richards, and a standard DRAM memory cell array. In these examples, individual voltage source (e.g. charge pump pixel cell) is addressed through a wordline, and the voltage states of the voltage source are controlled by a bitline.

The different voltage differences, such as those in table 1, are established to control the operation of the micromirror device, particularly for removing or preventing charge accumulation in micromirror the device. According to the invention, a selected voltage difference is established between the mirror plate and the electrode at one time, and the polarity of the voltage difference is inversed in accordance with a predetermined sequence such that charge accumulation can be removed or prevented. Specifically, a first voltage (e.g. $V_1$ in FIG. 3) and a third voltage $V_3$ are respectively applied to the mirror plate and the electrode in response to an actuation signal of a first sequence of actuation signals, wherein the voltage difference between the two voltages drives the mirror plate to rotate to either the ON state or the OFF state depending upon the definition of the actuation signals. In particular, when the actuation signals of the first actuation signal sequence are defined as the ON state, the voltage difference is the one (e.g. +30 volts) that rotates the mirror plate to the ON state angle. When the actuation signals are defined as the OFF state, the voltage difference is selected as the one (e.g. +20 volts, 0 volt or ground) that sets the mirror to the OFF state. Upon receiving another actuation signal of a second sequence of actuation signals, a second voltage $V_2$ and a fourth voltage $V_4$ are respectively applied to the mirror plate and the electrode. The difference between $V_2$ and $V_4$ rotates the mirror plate to either the ON state or the OFF state depending upon the definition of the actuation signal, while the polarity of the difference $V_2$ and $V_4$ is opposite to that between $V_1$ and $V_3$. The two sequences of actuation signals can be separate subsequences of a sequence of actuation signals, such as a sequence of actuation signals of a video frame, each actuation signal corresponding to the ON state of the micromirror device.

According to an embodiment of the invention, the first subsequence of actuation signals and the second subsequence of actuation signals are interleaved. That is, voltage differences with opposite polarities are established between the mirror plate and the electrode alternatively in response to the actuation signals and the polarity inversion of the voltage difference is performed every actuation signal, regardless of the first or the second subsequence. This embodiment is better illustrated in an example with reference to FIG. 4*a* through FIG. 5*a*, wherein pulse-width-modulation is employed in producing a 4 bit grayscale of a pixel with a grayscale level of 7. Of course, in real display applications, images with grayscales higher than 7 are generally produced.

In order to produce the perception of a grayscale or full-color image using micromirrors, the micromirrors are rapidly switched between the ON and OFF states such that an average of each pixel's modulated brightness waveform corresponds to the desired "analog" brightness for that pixel. Above a certain modulation frequency, the human eye and brain integrate each pixel's rapidly varying brightness (and color, in a field-sequential color display) and perceive an effective 'analog' brightness (and color) determined by the pixel's average illumination over a video frame.

Figure 4A:
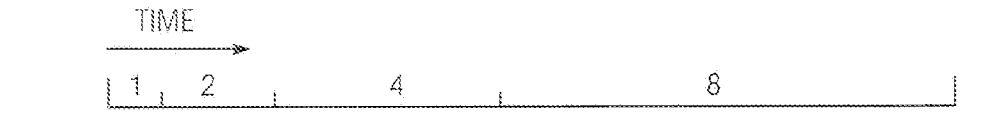
FIG. 4*a* presents a binary-weighted pulse-width-modulation waveform-format.
Figure 4B:
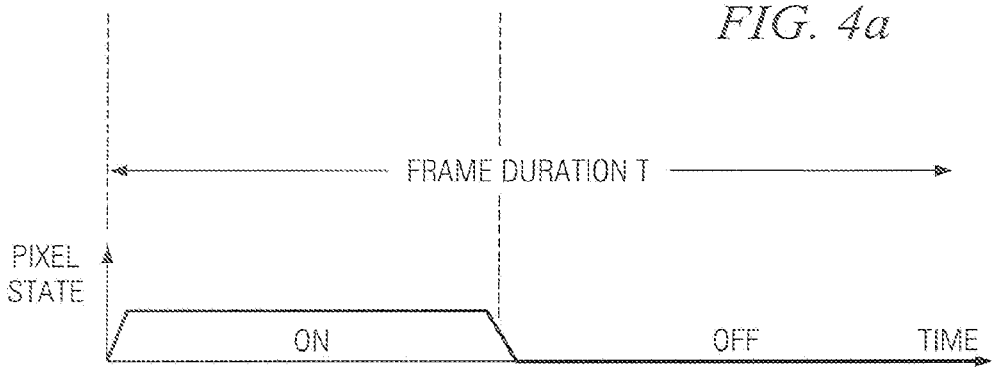
FIG. 4*b* demonstrates an exemplary waveform defined according to the waveform-format of FIG. 4*a* for driving the micromirrors of the spatial light modulator of FIG. 1.

Referring to FIG. 4*a*, a binary-weighted PWM waveform format is illustrated therein, the format assuming 4-bit grayscale. FIG. 4*b* illustrates a PWM waveform based on the waveform format in FIG. 4*a* for producing the desired grayscale level 7 for the pixel. The waveform has an ON segment and an OFF segment. The duration of the ON segment is 7 (7=1+2+4) segments of the total duration of the frame T (T=1+2+4+8=15 segments). During the ON segment, the micromirror device is turned on so as to generate a bright pixel, and during the OFF segments, the micromirror is turned off so as to generate a dark pixel. As an average over the frame duration T, the perceived "brightness" level of the pixel is 7 when the entire brightness range is measured with 15.

Figure 5A:
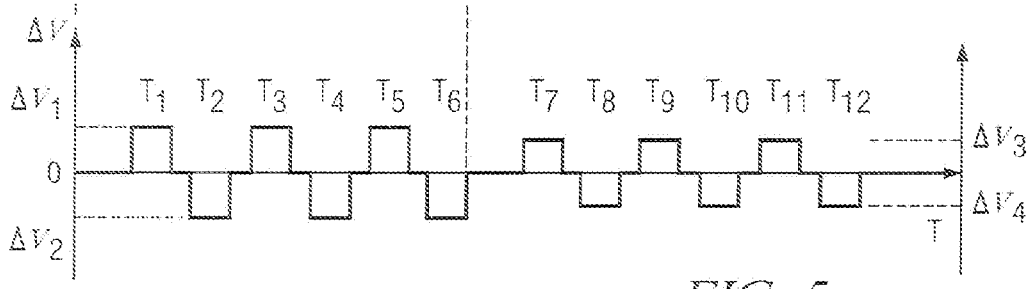
FIG. 5*a* illustrates an exemplary sequence of voltages established between the mirror plates and the electrodes of the spatial light modulator during a frame period for removing accumulated charges in FIG. 2 according to an embodiment of the invention.

During the ON segment of FIG. 4*b*, the micromirror device is trued on. This is achieved by applying different voltage differences across the mirror plate and the electrode. A sequence of voltage differences is illustrated in FIG. 5*a*. Specifically, a first voltage difference $\Delta V_1$ is established during the time intervals of $T_1$, $T_3$ and $T_5$. A second voltage difference $\Delta V_2$ is established during the time intervals of $T_2$, $T_4$ and $T_6$. As a result, voltage differences with opposite polarities are alternated between the mirror plate and the electrode of the micromirror device. In a particular example, $\Delta V_1$ is +30 volts and $\Delta V_2$ is −30 volts, as shown in table 1.

During the intervals, such as during intervals $T_1$ and $T_2$, short blanking periods are presented as an alternative feature of the embodiment, though the blanking periods are not necessarily in display applications. During each blanking period, other operations may be performed for the micromirror device. For example, the micromirror device resets its state and waits for following data or instructions to be loaded during the blanking period. The voltage difference of the blanking period is preferably zero as shown in the figure. However, this is not an absolute requirement. Rather, the blanking period can be of a suitable voltage difference between $\Delta V_1$ and $\Delta V_2$.

For the rest 8 segments of the PWM waveform corresponding to the OFF state of the micromirror, the mirror device is turned off. Different voltages are applied to the mirror plate and the electrode, yielding non-zero voltage differences between the mirror plate and the electrode. In particular, a positive voltage difference $\Delta V_3$ (e.g. +20 volts) is established between the mirror plate and the electrode during the time intervals of $T_7$, $T_9$ and $T_{11}$. And a negative voltage difference $\Delta V_4$ (e.g. −20 volts) is established during $T_8$, $T_{10}$ and $T_{12}$. In fact, the voltage difference for the OFF state can be zero. For example, applying the same voltage or a voltage difference less than the voltage for the ON state to the mirror and the electrode. In particular, the same voltage can be ground voltage.

According to another embodiment of the invention, polarity inversion of the voltage difference is performed after a number of applications of the first voltage difference. For example, during the 7 segments of the ON state in FIG. 4*b*, $\Delta V_1$ is established and maintained for 3 segments of the 7 segments. After the 3 segments, $\Delta V_2$ is established and the polarity is inversed for removing or preventing the charge accumulation. Alternatively, the polarity inversion is performed once per frame duration. This embodiment is better illustrated in FIG. 5*b*.

Figure 5B:
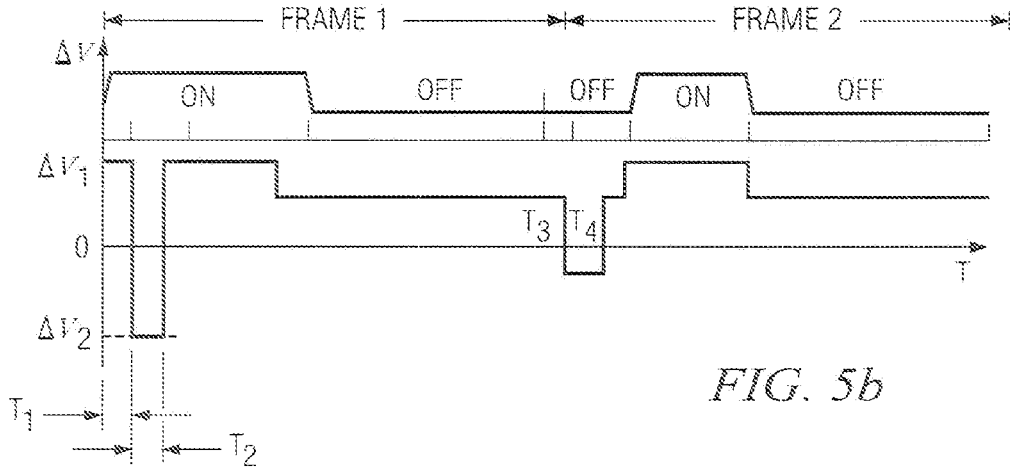
FIG. 5*b* illustrates another exemplary sequence of voltages established between the mirror plates and the electrodes of the spatial light modulator during two consecutive frame periods for removing charge accumulation in FIG. 2 according to another embodiment of the invention.

Referring to FIG. 5*b*, a sequence of voltage differences for two consecutive image (or video) frames is illustrated therein, wherein the first image frame has a grayscale of 7 out of a full-grayscale of 15, and the second image frame has a gray scale of 4 out of the full-grayscale. To produce the desired grayscales, the pixel is turned on for the first 7 PWM waveform segments and turned off for the rest 8 waveform segments for the first image frame. For the second frame, the pixel is turned off for the first 3 waveform segments followed by turned on for the next 4 waveform segments, and the pixel is turned off for the rest 8 waveform segments. During the ON segments of the first image frame, a first voltage difference $\Delta V_1$ is established between the mirror plate and the electrode such that the mirror plate is rotated to the ON state angle. After predefined time interval $T_1$, a second voltage difference $\Delta V_2$, which has an opposite polarity to $\Delta V_1$, is established between the mirror plate and the electrode for a time period $T_2$. After $T_2$ and during the rest waveform ON segments, the first voltage $\Delta V_1$ is established between and maintained by the mirror plate and the electrode.

During the OFF segment of the first image frame, a voltage difference $\Delta V_3$ is established between the mirror plate and the electrode for setting the mirror plate to the OFF state. This voltage difference is maintained for the entire OFF segment of the first image frame.

For the second frame, the voltage difference $\Delta V_3$ is established between and maintained by the mirror plate and the electrode for a time period $T_3$ for setting the micromirror to the OFF state. Then a voltage difference $\Delta V_4$, which has an opposite polarity to $\Delta V_3$ is established and maintained for a time period $T_4$. The voltage difference is switched back to $\Delta V_3$ for the rest 3 waveform segments corresponding to the OFF state of the micromirror. During the 4 ON waveform segments of the second image frame, $\Delta V_1$ is established between the mirror plate and the electrode for rotating the mirror plate to the OFF state angle. For the rest 8 OFF waveform segments, the voltage difference between the mirror plate and the electrode is set to $\Delta V_3$.

In the embodiments discussed above with reference to FIG. 4*a* through FIG. 5*b*, the time intervals $T_1$, $T_2$, $T_3$, $T_4$, $T_5$, $T_6$, $T_7$, $T_8$, $T_9$, $T_{10}$, $T_{11}$ and $T_{12}$ may be equal. Alternatively, each of these time intervals may be set to a different value in accordance with specific polarity inversion schemes employed.

Figure 1:
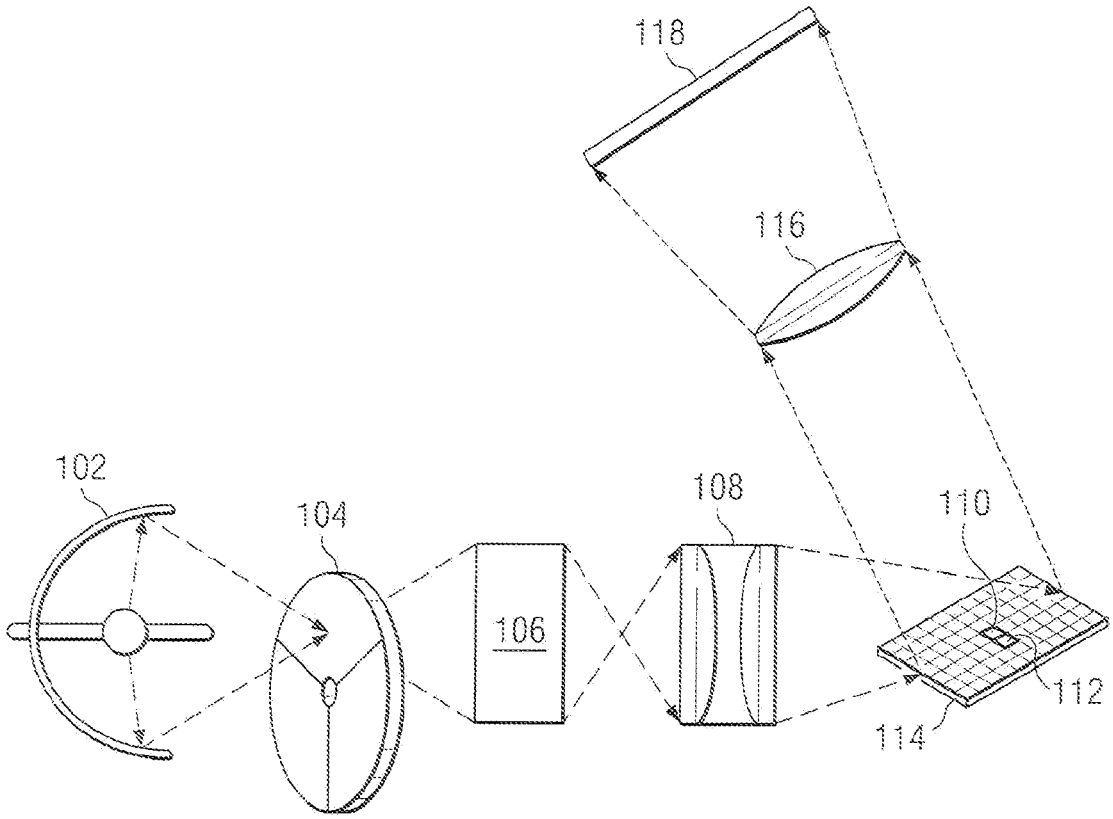
FIG. 1 illustrates a simplified display system employing a spatial light modulator having an array of micromirror devices.

As an aspect of the embodiment, the polarity inversion is determined according to the duration of the color segments of a color filter wheel (e.g. color filter wheel 104 in FIG. 1) of the display system. The color wheel generally has three color segments, corresponding to three primary colors—red, green and blue. And it may also have more than three color segments. For example, in addition to the primary colors, a color wheel may have a white segment. Alternatively, a color wheel may have a plurality of segments with two or more segments corresponding to each primary color or white. In operation, the color wheel rotates with a high frequency, for example, higher than 60 Hz. The inversion of the voltage difference can be performed with a frequency, preferably around or higher than 30 Hz. As another aspect of the embodiment, the inversion is performed at each beginning or each ending of displaying an image or a video frame.

According to yet another embodiment of the invention, the polarity inversion is performed at a frequency determined by the perceptual ability of human eyes. Specifically, the frequency of the polarity inversion is around or higher than the "flicker" frequency of human eyes. Though the flicker frequency depends upon many factors, such as brightness and color of stimulus, a value of at least 30 Hz is preferred for practice purposes. In this situation, human eyes will not be able to perceive any visual effect on the micromirror caused by the polarity inversion.

Figure 6:
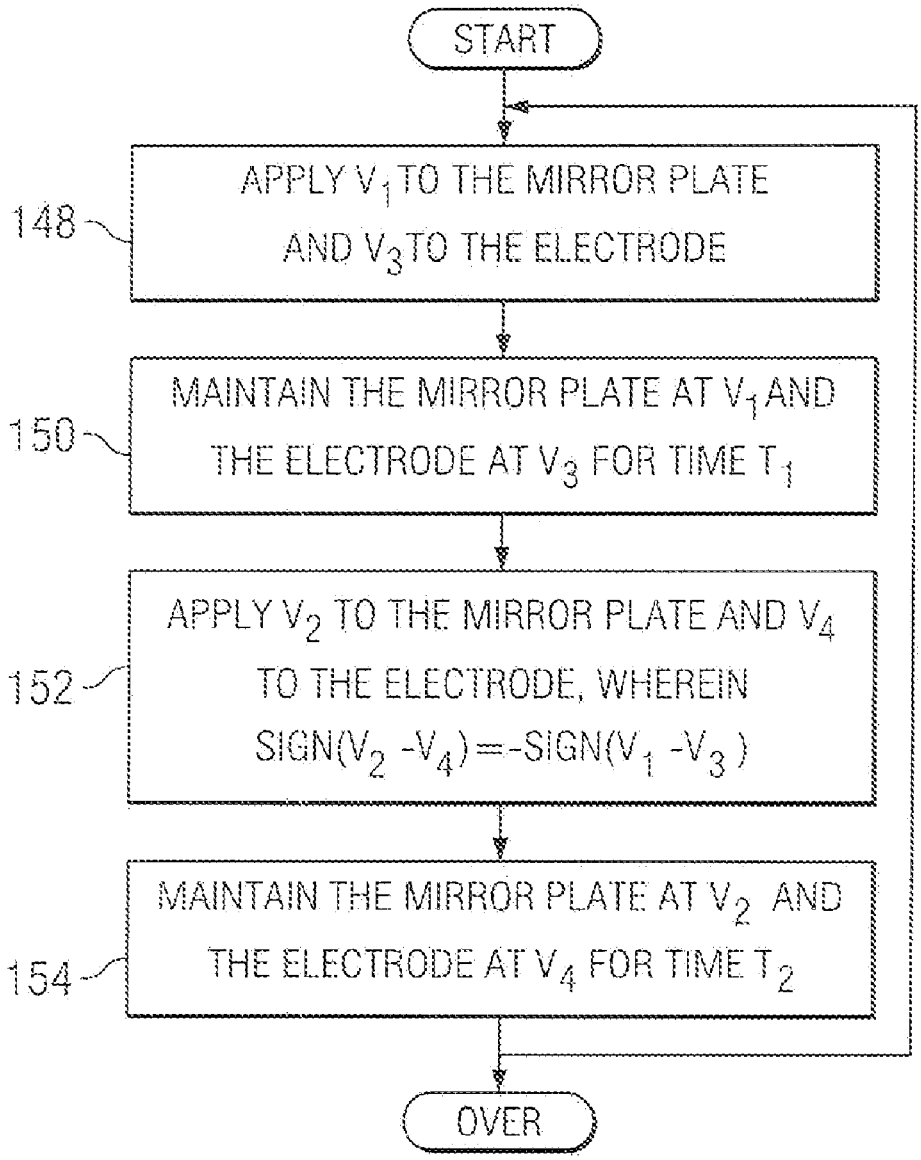
FIG. 6 is a flow chart showing steps executed for removing the accumulated charges in FIG. 2 according to the invention.

Referring to FIG. 6, a flow chart illustrating steps executed for preventing charge accumulation according to the embodiments of the invention is illustrated therein. At a time when an actuation signal is received, a first voltage $V_1$ and a third voltage $V_3$ are respectively applied to the mirror plate and the electrode of the micromirror device (step 148). The voltages can be of any suitable value, preferably from −100 to 100 volts, more preferably from −30 volts to 30 volts, more preferably around 30 volts. The voltage difference of $V_1$ and $V_3$ is able to rotate the mirror plate to either the ON state or the OFF state. It is preferred that the voltage difference $\Delta V=V_1-V_3$ has an absolute value from 15 to 80 volts, more preferably from 25 to 50 volts, more preferably around 30 volts. The mirror plate and the electrode are maintained at $V_1$ and $V_3$ voltages for a predetermined time interval $T_1$ (step 150). For example, $T_1$ is determined based on the desired frequency of polarity inversion of the voltage difference. It may also be determined by the desired polarity inversion process as discussed above. After $T_1$, in response to another activation signal, voltages $V_2$ and $V_4$ are respectively applied to the mirror plate and the electrode (step 152). The voltage difference of $V_2$ and $V_4$ is able to rotate the mirror plate to either the ON state or the OFF state, preferably in the same rotation direction as that driven by the voltage difference between $V_1$ and $V_3$. It is preferred that the voltage difference $\Delta V=V_2\Delta V_4$ has an absolute value from 15 to 80 volts, more preferably from 25 to 50 volts, more preferably around 30 volts. And the voltages can be of any suitable value, preferably from −100 to +100 volts, more preferably from −30 to +30 volts and more preferably around +30 volts for ON state, and more preferably around −20 volts for OFF state. It is further preferred that voltage $V_2$ has an opposite polarity to voltage $V_1$, and voltage $V_4$ has an opposite voltage to voltage $V_3$. The mirror plate and the electrode are then maintained at $V_2$ and $V_4$ voltages for a predetermined time interval $T_2$ (step 154). Similar to $T_1$, $T_2$ can be determined based on the desired frequency of polarity inversion of the voltage difference. It may also be determined by the desired polarity inversion process as discussed above. After the time $T_2$, the process either flows back to step 148 repeating the inversion or stops, depending upon the predetermined process. Specifically, the steps from 148 to 154 can be executed once at each beginning or ending of an image display or a video frame display. Alternatively, the steps 148 through 154 can be repeated during the display of an image frame or a video frame. Or the steps can be executed with a predetermined frequency.

Figure 7A:
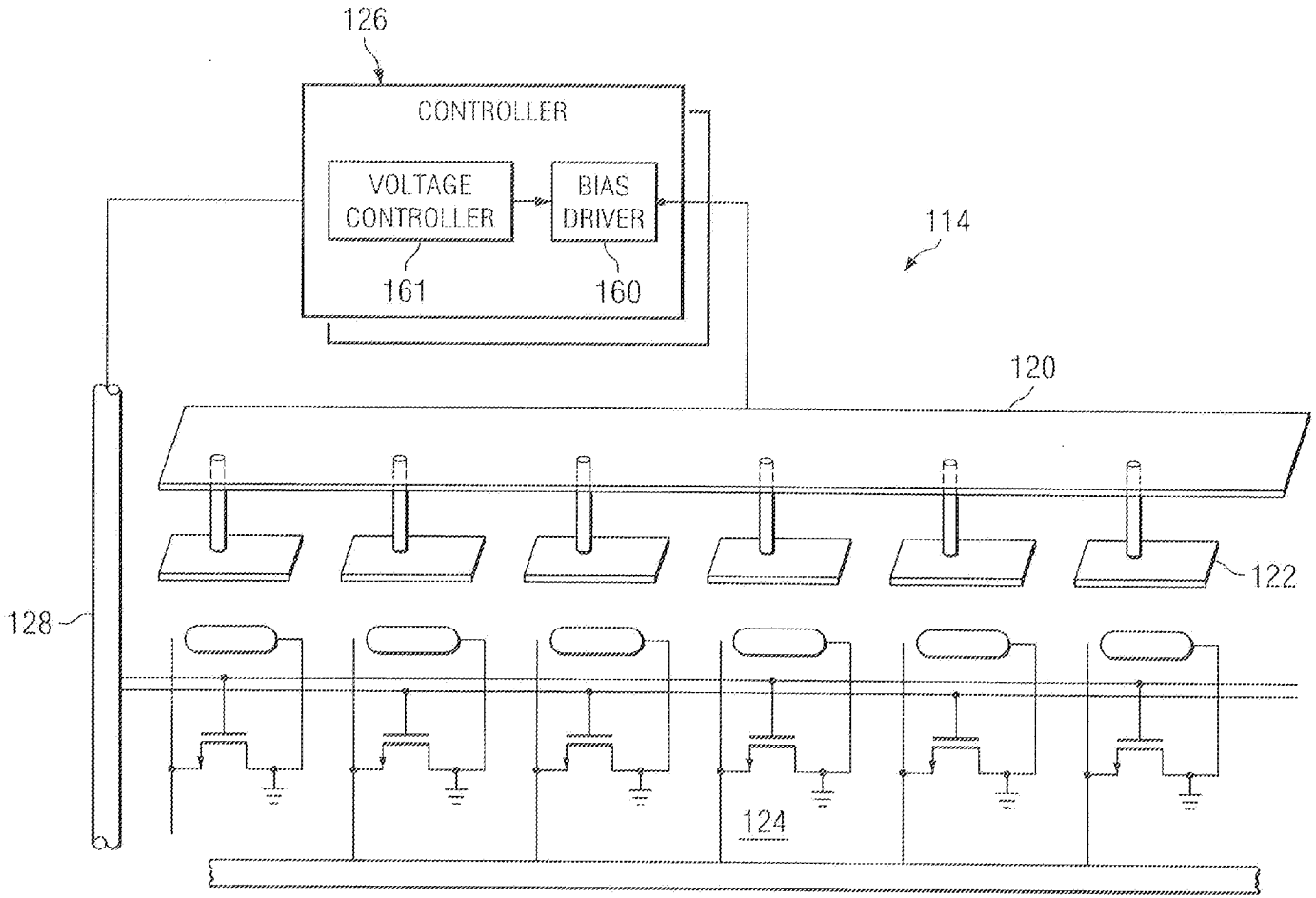
FIG. 7*a* schematically illustrates an apparatus that prevents the charge accumulation of FIG. 2 according to the invention.
Figure 7B:
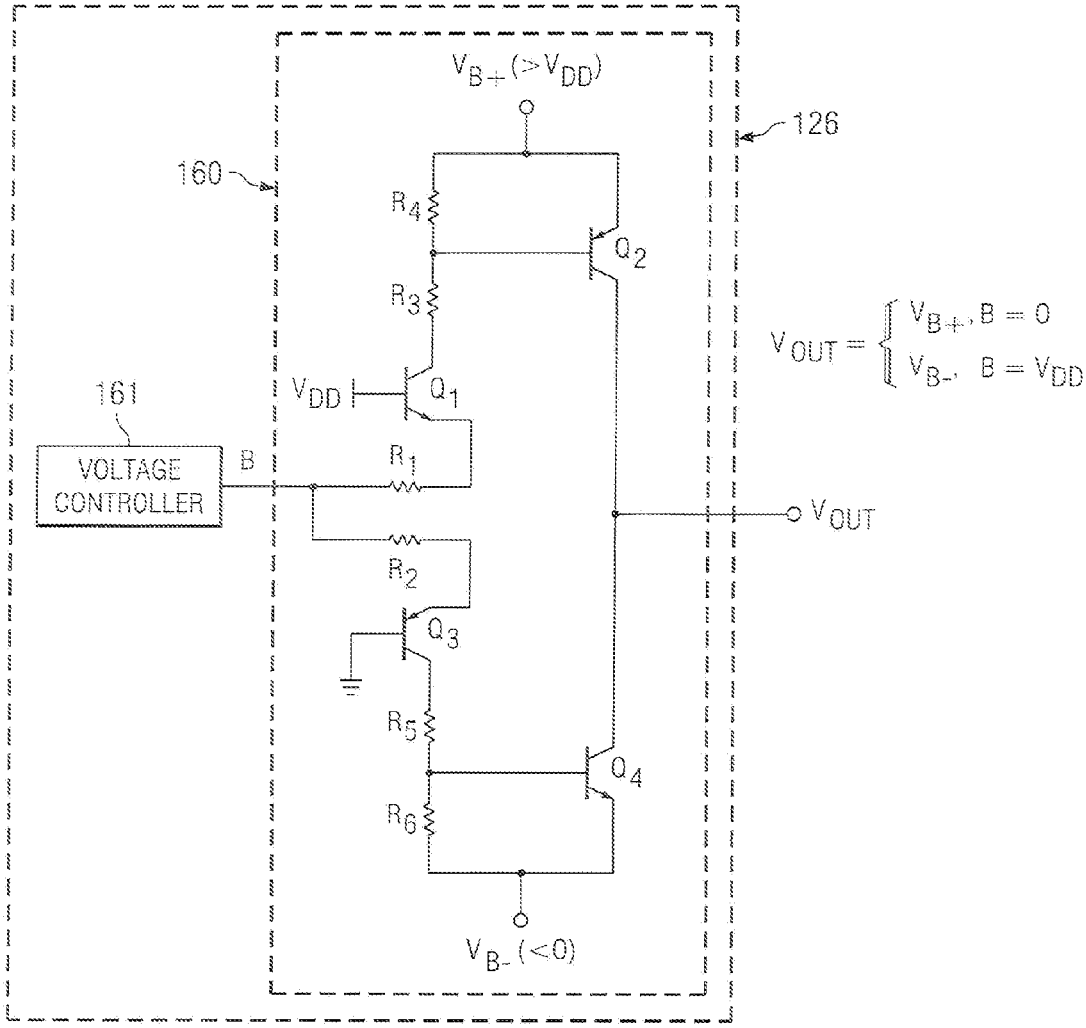
FIG. 7*b* presents an exemplary circuitry design of the controller in FIG. 7*a*.

The embodiments of the present invention can be implemented in a variety of ways. In an embodiment of the invention, the embodiments of the invention are implemented in bias driver 160 of controller 126, as shown in FIG. 7. Controller 126, which further comprises voltage controller 161, is a controlling unit that controls the voltages on the mirror plates and electrodes. Specifically, the controller selectively activates memory cells (e.g. memory cell 124) in response to activation signals and sets the selected memory cells into desired voltage states. The electrodes connected to the selected memory cells are accordingly set to desired voltages for driving the mirror plate to rotate bias inverter 160 controls applications of the voltages to the mirror plates and electrodes. In particular, bias driver 160 inverts polarity of voltage differences across mirror plates and electrodes in accordance with a predetermined procedure. As a way of example, FIG. 7*b* illustrates a circuit design for the bias driver of FIG. 7*a*. As can be seen from the figure, the design is composed of transistors $Q_1$, $Q_2$, $Q_3$ and $Q_4$, and resistors $R_1$, $R_2$, $R_3$, $R_4$, $R_5$ and $R_6$. The source of transistor $Q_2$ and one end of resistor $R_4$ form a voltage node $V_{B+}$. The drain of transistor $Q_4$ and one end of resistor $R_6$ form another voltage node $V_{B-}$. The gate of transistor $Q_1$ is set to voltage $V_{DD}$. In this particular circuit design, the output voltage $V_{out}$ from bias driver 160 depends upon the output signal B from voltage controller 161. Specifically, the $V_{out}$ of bias driver 160 is $V_{B+}$ (larger than $V_{DD}$) when the output signal B of voltage controller 161 is set to 0. And the output voltage $V_{out}$ is $V_{B-}$ (less than zero) when the output signal B of voltage controller 161 is set to $V_{DD}$. FIG. 7*b* shows an exemplary circuit design for the bias driver and the controller of FIG. 7*a*. In fact, the controller and the bias driver can be any suitable circuit design as long as they provide electric voltages to the mirror plate and/or the electrode and invert the polarity of the voltage difference between the mirror plate and the electrode.

Other than implementing the embodiments of the present invention in controller 126, the embodiments of the present invention may also be implemented in a microprocessor-based programmable unit, and the like, using instructions, such as program modules, that are executed by a processor. Generally, program modules include routines, objects, components, data structures and the like that perform particular tasks or implement particular abstract data types. The term "program" includes one or more program modules. When the embodiments of the present invention are implemented in such a unit, it is preferred that the unit communicates with the controller, takes corresponding actions to signals, such as actuation signals from the controller, and inverts polarity of the voltage differences.

It will be appreciated by those of skill in the art that a new and useful apparatus and method have been described herein. In view of many possible embodiments to which the principles of this invention may be applied, however, it should be recognized that the embodiments described herein with respect to the drawing figures are meant to be illustrative only and should not be taken as limiting the scope of invention. For example, those of skill in the art will recognize that the illustrated embodiments can be modified in arrangement and detail without departing from the spirit of the invention. In particular, a voltage source with more than two voltage states may be provided for the mirror plate and/or the electrode. Therefore, the invention as described herein contemplates all such embodiments as may come within the scope of the following claims and equivalents thereof.

I claim:

1. A method of operating a display system that comprises an array of micromirrors, each micromirror comprising a mirror plate and an electrode for rotating the mirror plate, the method comprising:

directing a light beam onto the micromirror array; and selectively reflecting the light beam into an optical element for producing an image or a video frame on a display target, which further comprises:

selecting one or more micromirrors from the micromirror array according to a gray scale of the image or the video frame;

applying a first voltage to the mirror plate and a second voltage to the electrode of the selected micromirror such that voltage difference between the mirror plate and the electrode drives the mirror plate to rotate to one of the ON state and OFF state of the micromirror relative to the substrate at one time; and applying a third voltage to the mirror plate, and a fourth voltage to the electrode of the selected micromirror such that the voltage difference between the mirror plate and the electrode drives the mirror plate to rotate relative to the substrate, wherein difference between the third voltage and the fourth voltage has an opposite polarity to that between the first voltage and the second voltage.

2. The method of claim 1, wherein step of applying the first voltage to the mirror plate and the second voltage to the electrode further comprises:

maintaining the first and second voltages on the mirror plate and the electrode for a time interval determined by the grayscale of the image or the video according to a pulse-width-modulation technique.

3. The method of claim 1, wherein step of applying the third voltage to the mirror plate and the fourth voltage to the electrode further comprises:

maintaining the third and fourth voltages on the mirror plate and the electrode for a time interval determined by the grayscale of the image or the video according to a pulse-width-modulation technique.

4. The method of claim 1, wherein the first voltage and the second voltage are applied in response to a first subsequence of a sequence of actuation signals, and the third voltage and the fourth voltage are applied in response to a second subsequence of the sequence of actuation signals.

5. The method of claim 2, wherein the actuation signal corresponds to an ON state of the micromirror, wherein the ON state is defined as a state such that the micromirror reflects light into a projection lens for producing a bright pixel of an image on a display target.

6. The method of claim 2, wherein the actuation signal corresponds to an OFF state of the micromirror, wherein the OFF state is defined as a state such that the micromirror reflects light away from a projection lens for producing a dark pixel of an image on a display target.

7. The method of claim 2, wherein the first subsequence and the second subsequence are interleaved.

8. The method of claim 2, wherein the second subsequence is determined such that a predetermined number of applications of the first and second voltages is between two consecutive applications of the third and fourth voltages.

9. The method of claim 2, wherein the second subsequence of the sequence of the actuation signals has a frequency more than a predetermined frequency, wherein the frequency is defined as the number of actuation signals in the subsequence per second.

10. The method of claim 7, wherein the frequency is determined in accordance with a perceptual ability of human eyes.

11. The method of claim 1, wherein the fourth voltage is zero.

12. The method of claim 1, wherein the step of applying the third voltage and the fourth voltage further comprises:

grounding the electrode.

13. The method of claim 1, wherein the step of applying the third voltage and the fourth voltage further comprises:

grounding the mirror plate.

14. The method of claim 1, wherein the third voltage has an opposite polarity to the first voltage.

15. The method of claim 1, wherein the fourth voltage has an opposite polarity to the second voltage.

16. The method of claim 1, wherein the difference between the first voltage and the second voltage is from 15 volts to 80 volts.

17. The method of claim 1, wherein the difference between the first voltage and the second voltage is from 25 volts to 50 volts.

18. The method of claim 1, wherein the difference between the first voltage and the second voltage is around 30 volts.

19. The method of claim 1, wherein the difference between the third voltage and the fourth voltage is from 15 volts to 80 volts.

20. The method of claim 1, wherein the difference between the third voltage and the fourth voltage is from 25 volts to 50 volts.

21. The method of claim 1, wherein the difference between the third voltage and the fourth voltage is around 30 volts.

22. The method of claim 1, wherein the first voltage and the second voltage are from 0 to 100 volts.

23. The method of claim 1, wherein the first voltage and the second voltage are from 0 to 50 volts.

24. The method of claim 1, wherein the first voltage and the second voltage are around 30 volts.

25. The method of claim 1, wherein the third voltage and the fourth voltage are from 0 to 100 volts.

26. The method of claim 1, wherein the third voltage and the fourth voltage are from 0 to 50 volts.

27. The method of claim 1, wherein the third voltage and the fourth voltage are around 50 volts.

28. The method of claim 1, wherein the second subsequence of the sequence of the actuation signal has a frequency higher than 30 Hz.

29. The method of claim 1, wherein the rotation of the mirror plate driven by the voltage difference between the third voltage and the fourth voltage is along a rotation direction that is the same as that of the mirror plate driven by the voltage difference between the first voltage and the second voltage.

30. The method of claim 1, wherein the application of the first voltage and the second voltage and the application of the third voltage and the fourth voltage are performed alternatively.

31. The method of claim 1, wherein the application of the first voltage and the second voltage and the application of the third voltage and the fourth voltage are performed once per video frame.

32. The method of claim 1, wherein the application of the first voltage and the second voltage and the application of the third voltage and the fourth voltage are performed once per time interval determined by a time interval between two consecutive color segments of a color wheel used by the display system in producing a color image.

33. The method of claim 1, wherein the application of the first voltage and the second voltage and the application of the third voltage and the fourth voltage are performed once per time interval determined by a wave-segment of a pulse-width-modulation waveform used in producing the grayscale of the image or the video frame.

34. The method of claim 1, wherein the application of the first voltage and the second voltage and the application of the third voltage and the fourth voltage are performed at the beginning of displaying the image or the video frame.

35. A display system, comprising:

a light source;

an array of micromirrors, each micromirror comprises a mirror plate and an electrode associated with the mirror plate for driving the mirror plate to rotate;

a voltage controller that: a) sets the mirror plate to a first voltage and the electrode to a second voltage such that the difference between the first voltage and the second voltage drives the mirror plate to rate; b) sets the mirror plate to a second voltage and the electrode to a fourth voltage such that the difference between the third voltage and the fourth voltage drives the mirror plate to rotate; and c) wherein the difference between the first voltage and second voltage has an opposite polarity than that between the third voltage and the fourth voltage; and a plurality of optical elements for directing light from the light source onto the array of micromirrors and directing the reflected light from the micromirrors onto a display target for producing an image or a video frame.

36. The display system of claim 35, wherein the first voltage and the second voltage are applied in response to a first subsequence of a sequence of actuation signals, and the third voltage and the fourth voltage are applied in response to a second subsequence of the sequence of actuation signals.

37. The display system of claim 36, wherein the actuation signal corresponds to an ON state of the micromirror, wherein the ON state is defined as a state such that the micromirror reflects light into a projection lens for producing a bright pixel of an image on a display target.

38. The display system of claim 36, wherein the actuation signal corresponds to an OFF state of the micromirror, wherein the OFF state is defined as a state such that the micromirror reflects light away from a projection lens for producing a dark pixel of an image on a display target.

39. The display system of claim 36, wherein the first subsequence and the second subsequence are interleaved.

40. The display system of claim 36, wherein the second subsequence is determined such that a predetermined number of applications of the first and second voltages is between two consecutive applications of the third and fourth voltages.

41. The display system claim 35, wherein the second subsequence of the sequence of the actuation signals has a frequency more than a predetermined frequency, wherein the frequency is defined as the number of actuation signals in the subsequence per second.

42. The display system of claim 41, wherein the predetermined frequency is determined in accordance with a perceptual ability of human eyes.

43. The display system of claim 35, wherein the difference fourth voltage is zero.

44. The display system of claim 43, wherein the voltage controller further comprises:

a means for grounding the electrode.

45. The display system of claim 35, wherein the voltage controller further comprises:

a means for grounding the mirror plate.

46. The display system of claim 35, wherein the third voltage has an opposite polarity to the first voltage.

47. The display system of claim 35, wherein the fourth voltage has an opposite polarity to the second voltage.

48. The display system of claim 35, wherein the difference between the first voltage and the second voltage is from 15 volts to 80 volts.

49. The display system of claim 35, wherein the difference between the first voltage and the second voltage is from 25 volts to 50 volts.

50. The display system of claim 35, wherein the difference between the first voltage and the second voltage is around 30 volts.

51. The display system of claim 35, wherein the difference between the third voltage and the fourth voltage is from 15 volts to 80 volts.

52. The display system of claim 35, wherein the difference between the third voltage and the fourth voltage is from 25 volts to 50 volts.

53. The display system of claim 35, wherein the difference between the third voltage and the fourth voltage is around 30 volts.

54. The display system of claim 35, wherein the first voltage and the second voltage are from 0 to 100 volts.

55. The display system of claim 35, wherein the first voltage and the second voltage are from 0 to 50 volts.

56. The display system of claim 35, wherein the first voltage and the second voltage are around 30 volts.

57. The display system of claim 35, wherein the third voltage and the fourth voltage are from 0 to 100 volts.

58. The display system of claim 35, wherein the third voltage and the fourth voltage are from 0 to 50 volts.

59. The display system of claim 35, wherein the third voltage and the fourth voltage are around 50 volts.

60. The display system of claim 35, wherein the second subsequence of the sequence of the actuation signal has a frequency higher than 30 Hz.

61. A display system, comprising:

a light source;

an array of micromirrors, each micromirror comprises a mirror plate and an electrode associated with the mirror plate for driving the mirror plate to rotate;

a voltage controller that further comprise:

a means for setting the mirror plate to a first voltage and the electrode to a second voltage such that the difference between the first voltage and the second voltage drives the mirror plate to rate;

a means for setting the mirror plate to a third voltage and the electrode to a fourth voltage such that the difference between the third voltage and the fourth voltage drives the mirror plate to rotate; and wherein the difference between the first voltage and second voltage has an opposite polarity than that between the third voltage and the fourth voltage; and a plurality of optical elements for directing light from the light source onto the array of micromirrors and directing the reflected light from the micromirrors onto a display target for producing an image or a video frame.

62. A computer-readable medium having computer-executable instructions for performing steps of controlling spatial light modulations of an array of micromirrors used in a display system, wherein each micromirror of the array comprises a movable mirror plate and an electrode driving the mirror plate to rotate, the steps comprising:

selecting one or more micromirrors from the micromirror array according to a gray scale of an image or a video frame;

applying a first voltage to the mirror plate and a second voltage to the electrode of the selected micromirror such that voltage difference between the mirror plate and the electrode drives the mirror plate to rotate to one of the ON state and OFF state of the micromirror relative to the substrate at one time; and applying a third voltage to the mirror plate and a fourth voltage to the electrode of the selected micromirror such that the voltage difference between the mirror plate and the electrode drives the mirror plate to rotate relative to the substrate, wherein difference between the third voltage and the fourth voltage has an opposite polarity to that between the first voltage and the fourth voltage at another time.

63. A projector comprising:

a light source;

a spatial light that selectively reflecting light from the light source modulator that comprises an array of micromirrors, each micromirror having a movable mirror plate and an electrode driving the mirror plate to rotate;

a controller having computer-executable instructions for performing steps of controlling the selective reflection of the spatial light modulator, the steps comprising:

selecting one or more micromirrors from the micromirror array according to a gray scale of an image or a video frame;

applying a first voltage to the mirror plate and a second voltage to the electrode of the selected micromirror such that voltage difference between the mirror plate and the electrode drives the mirror plate to rotate to one of the ON state and OFF state of the micromirror relative to the substrate at one time; and applying a third voltage to the mirror plate and a fourth voltage to the electrode of the selected micromirror such that the voltage difference between the mirror plate and the electrode drives the mirror plate to rotate relative to the substrate, wherein difference between the third voltage and the fourth voltage has an opposite polarity to that between the first voltage and the second voltage; and a plurality of optical elements for directing light from the light source onto the spatial light modulator and projecting the reflected light from the spatial light modulator onto a display target of the projector.

* * * * *